US009991590B2

(12) United States Patent
Korva et al.

(10) Patent No.: US 9,991,590 B2
(45) Date of Patent: Jun. 5, 2018

(54) SHORT-RANGE ANTENNA STRUCTURE AND METHODS

(71) Applicant: Pulse Finland Oy, Kempele (FI)

(72) Inventors: Heikki Korva, Tupos (FI); Tuomas Jaasko, Oulu (FI)

(73) Assignee: PULSE FINLAND OY, Oulunsalo (FI)

( * ) Notice: Subject to any disclaimer, the term of this patent is extended or adjusted under 35 U.S.C. 154(b) by 911 days.

(21) Appl. No.: 14/031,722

(22) Filed: Sep. 19, 2013

(65) Prior Publication Data

US 2015/0077293 A1 Mar. 19, 2015

(51) Int. Cl.

| | |
|---|---|
| ***H01Q 1/52*** | (2006.01) |
| ***H01Q 1/24*** | (2006.01) |
| ***H01Q 7/06*** | (2006.01) |

(52) U.S. Cl.

CPC ..... *H01Q 1/526* (2013.01); *H01Q 1/243* (2013.01); *H01Q 7/06* (2013.01); *Y10T 29/49016* (2015.01)

(58) Field of Classification Search

CPC ..... H01Q 1/526; H01Q 1/243; H01Q 7/06; H01Q 1/24; H01Q 7/00

See application file for complete search history.

(56) References Cited

U.S. PATENT DOCUMENTS

| | | | | |
|---|---|---|---|---|
| 4,754,284 | A * | 6/1988 | Ohe | H01Q 7/00 343/712 |
| 5,420,599 | A * | 5/1995 | Erkocevic | H01Q 1/243 343/702 |
| 8,056,819 | B2 * | 11/2011 | Rowell | G01R 33/34007 235/487 |
| 2008/0303735 | A1 * | 12/2008 | Fujimoto | H01Q 1/22 343/787 |
| 2013/0147675 | A1 * | 6/2013 | Kato | H01Q 1/38 343/788 |
| 2013/0229314 | A1 | 9/2013 | Kuehler et al. | |
| 2013/0321230 | A1 * | 12/2013 | Merlin | H01Q 1/2225 343/787 |
| 2014/0027520 | A1 * | 1/2014 | Kato | H04B 5/0075 235/492 |

* cited by examiner

*Primary Examiner* — Graham Smith
*Assistant Examiner* — Noel Maldonado
(74) *Attorney, Agent, or Firm* — Gazdzinski & Associates, PC

(57) ABSTRACT

Antenna apparatus and methods of use and tuning. In one exemplary embodiment, the solution of the present disclosure is particularly adapted for small form-factor, metal-encased applications such as smartphones or tablets (and "phablets") utilizing near field communication (NFC) interfaces. The solution increases the effective size of the antenna without requiring any significant additional space or other structural modifications to the host device (such as changes to the device's metal case or size), while still maintaining a high degree of electrical performance (including a high Q factor).

18 Claims, 12 Drawing Sheets

| Y [mm] | | | | | |
|---|---|---|---|---|---|
| 15 | NR | 1 | NR | 1 | NR |
| 7.5 | NR | NR | NR | NR | NR |
| 0 | NR | NR | NR | NR | NR |
| -7.5 | NR | NR | NR | 1 | NR |
| -15 | 5 | 5 | 6 | 5 | 4 |
| | -15 | -7.5 | 0 | 7.5 | 15 |
| | X [mm] | | | | |

| | |
|---|---|
| AVERAGE: | 1.1 |
| MAXIMUM: | 6.0 |

57mm x 5mm

| Y [mm] | | | | | |
|---|---|---|---|---|---|
| 15 | 13 | 14 | 15 | 14 | 11 |
| 7.5 | 16 | 18 | 18 | 18 | 16 |
| 0 | 18 | 19 | 20 | 19 | 17 |
| -7.5 | 18 | 19 | 19 | 19 | 17 |
| -15 | 16 | 17 | 17 | 16 | 14 |
| | -15 | -7.5 | 0 | 7.5 | 15 |
| | X [mm] | | | | |

| | |
|---|---|
| AVERAGE: | 16.7 |
| MAXIMUM: | 20.0 |

57mm x 7mm

| Y [mm] | | | | | |
|---|---|---|---|---|---|
| 15 | 22 | 24 | 25 | 25 | 23 |
| 7.5 | 23 | 25 | 26 | 26 | 24 |
| 0 | 22 | 24 | 25 | 24 | 23 |
| -7.5 | 18 | 20 | 21 | 19 | 18 |
| -15 | 10 | 12 | 12 | 11 | 10 |
| | -15 | -7.5 | 0 | 7.5 | 15 |
| | X [mm] | | | | |

| | |
|---|---|
| AVERAGE: | 20.5 |
| MAXIMUM: | 26.0 |

54mm x 16mm

57mm x 5mm

EMVCo LOAD MODULATION - COMPARISON

| PEAK | R=0 | R=1 | R=2 | R=3 | R=4 | R=5 | R=6 | R=7 | R=8 |
|---|---|---|---|---|---|---|---|---|---|
| Z=0 | 6.0 | 4.5 | | 3.6 | | 5.8 | | 3.8 | |
| | -32% | -8% | | -27% | | -18% | | -22% | |
| Z=1 | 2.3 | 1.5 | 0.0 | 1.8 | 1.1 | 1.8 | 1.3 | 3.6 | 1.1 |
| | -68% | -63% | -100% | -56% | -56% | -56% | -48% | -61% | -56% |
| Z=2 | 1.0 | 0.0 | 0.0 | 1.0 | 0.0 | 1.0 | 0.0 | 1.0 | 0.0 |
| | -82% | -100% | -100% | -70% | -100% | -70% | -100% | -70% | -100% |
| Z=3 | 0.0 | 0.0 | 0.0 | 0.0 | 0.0 | 0.0 | 0.0 | 0.0 | 0.0 |
| | -100% | -100% | -100% | -100% | -100% | -100% | -100% | -100% | -100% |
| Z=4 | 0.0 | 0.0 | | 0.0 | | 0.0 | | 0.0 | |
| | -100% | -100% | | -100% | | -100% | | -100% | |

FIG. 6A
(PRIOR ART)

57mm x 7mm

| PEAK | R=0 | R=1 | R=2 | R=3 | R=4 | R=5 | R=6 | R=7 | R=8 |
|---|---|---|---|---|---|---|---|---|---|
| Z=0 | 12.8 | 9.8 | | 8.5 | | 9.6 | | 8.1 | |
| | 45% | 100% | | 73% | | 96% | | 65% | |
| Z=1 | 5.8 | 4.3 | 2.6 | 4.0 | 2.6 | 4.1 | 1.7 | 3.8 | 2.6 |
| | -19% | 5% | 4% | -2% | 4% | 0% | -32% | -7% | 4% |
| Z=2 | 2.6 | 1.7 | 1.3 | 1.9 | 1.3 | 1.7 | 1.1 | 1.9 | 1.0 |
| | -54% | -48% | -38% | -42% | -38% | -48% | -48% | -42% | -52% |
| Z=3 | 1.1 | 1.1 | 0.0 | 1.3 | 0.0 | 1.1 | 0.0 | 1.1 | 0.0 |
| | -73% | -56% | -100% | -48% | -100% | -56% | -100% | -56% | -100% |
| Z=4 | 0.0 | 0.0 | | 0.0 | | 0.0 | | 0.0 | |
| | -100% | -100% | | -100% | | -100% | | -100% | |

FIG. 6B
(PRIOR ART)

54mm x 16mm

| PEAK | R=0 | R=1 | R=2 | R=3 | R=4 | R=5 | R=6 | R=7 | R=8 |
|---|---|---|---|---|---|---|---|---|---|
| Z=0 | 22.8 | 15.6 | | 19.8 | | 26.1 | | 17.3 | |
| | 159% | 218% | | 304% | | 433% | | 253% | |
| Z=1 | 14.3 | 5.5 | 2.1 | 11.5 | 6.4 | 15.8 | 13.7 | 9.6 | 5.5 |
| | 99% | 34% | -16% | 180% | 156% | 285% | 448% | 134% | 120% |
| Z=2 | 5.6 | 3.6 | 1.7 | 4.5 | 3.6 | 6.4 | 5.1 | 4.9 | 3.4 |
| | 0% | 9% | -19% | -36% | 71% | 94% | 143% | 48% | 62% |
| Z=3 | 3.4 | 1.9 | 1.1 | 2.6 | 1.7 | 3.6 | 3.0 | 2.4 | 1.7 |
| | -15% | -24% | -35% | -4% | 0% | 44% | 76% | -4% | 0% |
| Z=4 | 1.7 | 1.1 | | 1.7 | | 1.9 | | 1.5 | |
| | -29% | -35% | | 0% | | -12% | | -12% | |

FIG. 6C

SHORT-RANGE ANTENNA STRUCTURE AND METHODS

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Technological Field

The present disclosure relates generally to an antenna apparatus for use in electronic devices such as e.g., wireless or portable radio devices, and more particularly in one exemplary aspect to a short-range antenna apparatus for use within e.g., a metal device or a device with a metallic surface, and methods of utilizing the same.

2. Description of Related Technology

Antennas are commonly found in most modern radio devices, such as mobile computers, portable navigation devices, mobile phones, smartphones, personal digital assistants (PDAs), or other personal communication devices (PCD). One area of increasing interest relates to short-range radio frequency interfaces, such as so-called "near field communication" (NFC) and radio frequency identification (RFID) systems. These interfaces are used to wirelessly transfer information, whether in an active mode or passive mode (or combinations thereof) between two entities, such as when one "bumps" their NEC-enabled smartphone against an in-store reader to complete a purchase transaction. Typically, antennas in such short-range interfaces comprise a planar radiating element (e.g., a loop) with a ground plane that is generally parallel to the planar radiating element. The term "near-field" refers generally to the fact the energy radiated by the antenna (or readable by the antenna) is stored in a spatially proximate region to the face of the antenna.

A typical NFC antenna may be for instance a planar loop with 3-5 rounds or loops of conductive trace, wherein the ground plane is generally parallel to the planar loop. This type of antenna requires a typical area on the order of 40×20 mm for adequate performance. However, in many metal cover devices, such a comparatively large metal-free area is not usually available within the cover. For instance, the available metal-free area may be as little as 5 mm in width, making such prior art loop-type antenna impractical.

When the X- or Y-dimension (i.e., planar dimension) of the aforementioned prior art antenna loop is decreased (e.g., to try to fit it within the aforementioned 5 mm-wide space), the parallel loop traces with opposite currents are disposed increasingly closer to each other. This reduced spacing causes cancellation of net current in the loop's generated near-field. This causes a decrease in loop inductance and so-called "Q" value or quality factor (in effect, a measure of the antenna's bandwidth and energy stored in the near field).

Some attempts to work around the foregoing limitations have included for example, increasing the amount of plastic or other dielectric material area in the metal cover, so as to allow for the larger form factor loop. However, one salient drawback of this approach is the decreased metal area, which leads to reduced mechanical strength and a visually less attractive device. Many device manufacturers will simply not tolerate the sacrifice in strength and aesthetics; the NFC antenna must accommodate the design and aesthetic dictated by the host device, and not the inverse.

Another prior art approach includes the use of a slot in the metal back cover of the device to excite image currents in the metal cover. However, this approach also produces less-than-optimal results, particularly with respect to producing a low inductance and Q-value, and hence poor antenna performance.

Accordingly, there is a salient need for a short-range antenna solution for use with, for example, a portable radio device having a small form factor metal body and/or external metallic surface that provides for the desired level of antenna performance, yet which is also compatible with the spatial and other constraints imposed by the use of a metallic cover.

SUMMARY

The present disclosure satisfies the foregoing needs by providing, inter alia, a space-efficient short-range antenna apparatus for use within various configurations (including e.g., a metal housing), and methods of tuning and use thereof.

In a first aspect, a short-range antenna apparatus is disclosed. In one embodiment, the antenna apparatus includes: at least one antenna loop, the at least one loop comprising a first portion and a second portion. The first portion is configured to operate as a radiating portion, and the second portion is configured to operate as an impedance matching portion.

In one variant, the at least one antenna loop is configured to operate as a near-filed antenna for very short-range communications.

In another variant, the at least one antenna loop is configured to operate at a frequency between 13 MHz and 14 MHz (e.g., 13.56 MHz), and is compliant with an EMVCo standard when operated at that frequency.

In a further variant, the second portion is disposed proximate at least one shield element, the at least one shield element configured to shield at least the second portion from one or more metallic components proximate the antenna loop.

In another aspect, a wireless enabled mobile device is disclosed. In one embodiment, the device includes: a short-range radio frequency antenna comprising at least one loop, the at least one loop comprising a first radiating portion and a second portion, the second portion disposed proximate one or more metallic components in the device; and at least one shielding element disposed proximate the one or more metallic components and configured to shield at least a portion of the second portion from the one or more metallic components.

In one variant, the second portion provides at least an impedance matching function for the short-range antenna.

In another variant, the short-range radio frequency antenna is disposed on a substrate, the at least one shielding element comprises two shielding elements, and at least a portion of the substrate and the second portion are disposed substantially between the two shielding elements.

In a further variant, the at least one shielding element allows the short-range antenna to be larger than it would be otherwise with no shielding element.

In another variant, the at least one shielding element allows the short-range antenna to have an increased effective or electrical size.

In yet another variant, the device further includes: a display element; and a printed circuit board. The short-range antenna comprises a substrate, the at least one loop formed on or in the substrate, the at least one shielding element comprises two shielding elements, and at least a portion of the substrate is disposed between the two shielding elements, and at least a portion of each of the two shielding elements is disposed between the display element and the circuit board.

In another aspect, a short-range antenna assembly is disclosed. In one embodiment, the assembly includes: a short-range radio frequency antenna comprising at least one loop, the at least one loop comprising a first radiating portion and a second portion, the at least one loop disposed on a substrate; and two or more shielding elements disposed proximate the second portion and configured to shield at least a portion of the second portion from one or more metallic components of a host device.

In one variant, the two or more shielding elements comprise ferrite shielding elements.

In another variant, the substrate comprises a substantially flexible substrate, the substrate shaped such that the first radiating portion of the at least one loop is disposed at an angle relative to the second portion.

In yet another aspect, a method of configuring an antenna is disclosed. In one embodiment, the antenna is for use in a constrained space so that it operates as an electrically larger antenna than allowed by said space, and the method comprises extending at least one loop of the antenna outside of the space and proximate at least one host device component and shield element, thereby creating a radiating portion within the space, and a non-radiating portion outside the space.

In one variant, the near-field antenna, when configured according to the method, is capable of utilizing a metal-free region of a host device that is smaller than a size of the at least one conductive loop.

In another variant, the method further includes shielding the second portion from the one or more components of the host device so as to facilitate the impedance matching.

In yet another aspect, a wireless device is disclosed. In one embodiment, the device includes: an at least partly metallic case or housing; a near-field wireless transceiver; at least one shielding element; and a near field antenna disposed proximate the case or housing, the near field antenna comprising a first radiating portion disposed proximate a metal-free region of the case or housing, and a second portion disposed proximate to both the at least one shielding element and a metallic portion of the case or housing. In one variant, the at least one shielding element shields the second portion from the metallic portion, such that only the first radiating portion radiates electromagnetic energy from the wireless device.

In another aspect, a method of increasing an effective electrical size of a short-range radio frequency antenna in a prescribed available radiating area is disclosed. In one embodiment, the method includes disposing a first portion of a conductive loop of the antenna within the radiating area, and a second portion of the conductive loop in a non-radiating area, and shielding the second portion from proximate metallic components such that the second portion does not radiate.

In a further aspect, a method of tuning a short range antenna apparatus is disclosed.

In another aspect, a portable communications device comprising the aforementioned antenna apparatus is disclosed.

In a further aspect, a method of operating the aforementioned antenna apparatus is disclosed.

In a further aspect, a method of manufacturing the aforementioned antenna apparatus is disclosed.

Further features of the present disclosure, its nature and various advantages will be more apparent from the accompanying drawings and the following detailed description.

BRIEF DESCRIPTION OF THE DRAWINGS

The features, objectives, and advantages of the present disclosure will become more apparent from the detailed description set forth below when taken in conjunction with the drawings, wherein:

FIGS. 6A-6C are tables showing EMVCo load modulation for prior art 57×5 mm and 57×7 mm antenna form factors, and one embodiment (54×16 mm) of the inventive antenna of the present disclosure, respectively.

Figure 1:
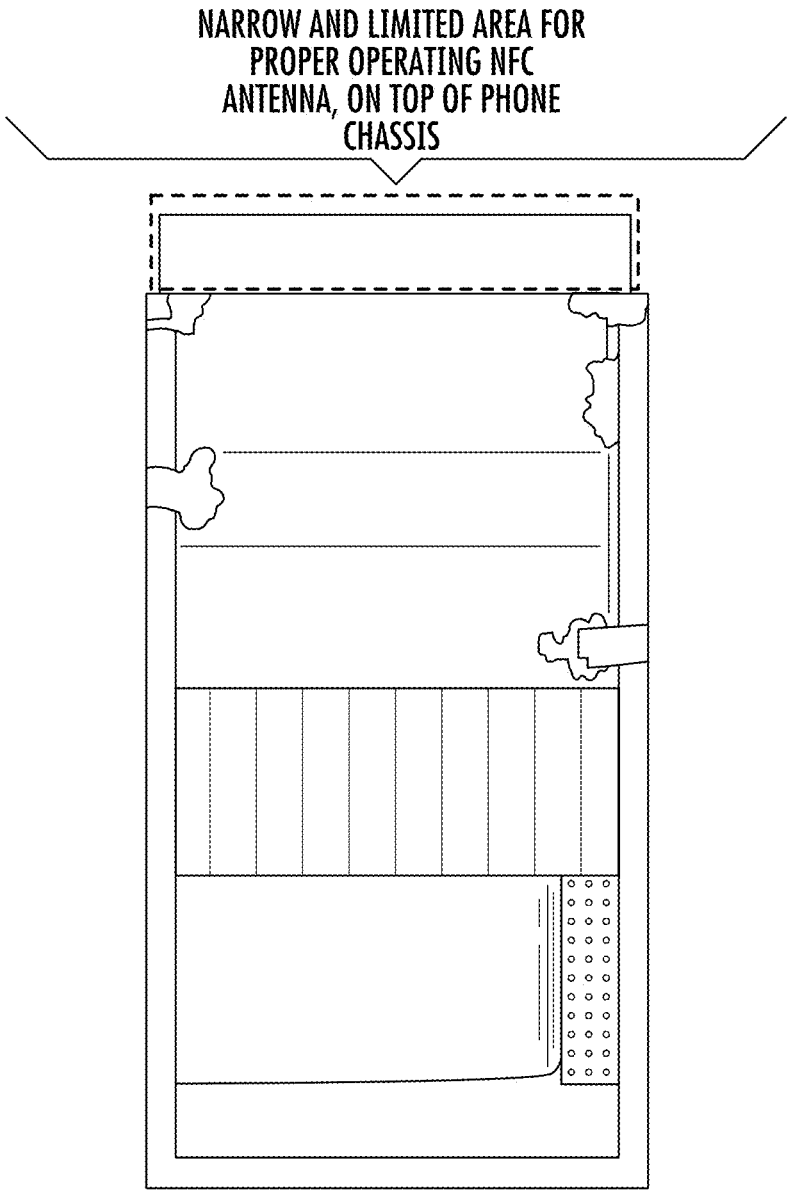
FIG. 1 (PRIOR ART)
FIG. 1 is an elevation view of a laboratory model prior art cellular telephone showing the available area for a short-range (e.g., NFC) antenna.

All Figures disclosed herein are © Copyright 2013 Pulse Finland Oy. All rights reserved.

DETAILED DESCRIPTION OF THE PREFERRED EMBODIMENT

Reference is now made to the drawings wherein like numerals refer to like parts throughout.

As used herein, the terms "antenna", and "antenna assembly" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

The terms "frequency range", and "frequency band" refer without limitation to any frequency range for communicating signals. Such signals may be communicated pursuant to one or more standards or wireless air interfaces.

As used herein, the terms "portable device", "mobile device", "client device", and "computing device", include, but are not limited to, personal computers (PCs) and mini-computers, whether desktop, laptop, or otherwise, set-top boxes, personal digital assistants (PDAs), handheld computers, personal communicators, tablet computers, portable navigation aids, J2ME equipped devices, cellular telephones, smartphones, tablet computers, personal integrated communication or entertainment devices, portable navigation devices, or literally any other device capable of processing data.

Furthermore, as used herein, the terms "radiator," "radiating plane," and "radiating element" refer without limitation to an element that can function as part of a system that receives and/or transmits radio-frequency electromagnetic radiation; e.g., an antenna. Hence, an exemplary radiator may receive electromagnetic radiation, transmit electromagnetic radiation, or both.

The terms "feed", and "RF feed" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the term "short range" refers without limitation to radio frequency interfaces or technologies adapted for or suitable for use at limited range, including for example and without limitation variants of so-called "near field communication (NFC)" and radio frequency identification (RFID), including the technologies specified by standards such as e.g., ISO 14443 A/B, ISO 18000-3, and EMVCo 2.0 and subsequent.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, Zigbee, short range wireless (see above), CDPD, satellite systems such as GPS and GLONASS, and millimeter wave or microwave systems.

Overview

In one salient aspect, the present disclosure provides improved short-range antenna apparatus and methods of use and tuning.

In one exemplary embodiment, the solution of the present disclosure utilizes ferrite or comparable shield elements to minimize the effects of the metal casing. Such solution is particularly adapted for small form-factor, metal-encased applications that utilize short-range wireless interfaces (e.g., NFC or RFID) such as smartphones or tablets/phablets, and obviates the disabilities of the prior art relating to either altered metal case geometry, or use of the case as part of the antenna excitation (e.g., placement of slot in the back case).

Advantageously, exemplary embodiments of the antenna of the present disclosure maintain a high degree of electrical performance (i.e., high Q and high inductance), with no sacrifice in aesthetics or dictates on the placement or percentage of the host device case which can be metal. This advantageously permits, for example, maximization of the metal area that can be used on the device back cover, and also for a uniform metal surface (i.e., an unbroken metallic construction and appearance)

Moreover, the foregoing exemplary embodiments provide an antenna which is highly spatially compact, thereby providing the added benefit of increased availability of space within the host device case.

Detailed Description of Exemplary Embodiments

Detailed descriptions of the various embodiments and variants of the apparatus and methods of the disclosure are now provided. While primarily discussed in the context of portable radio devices, such as smartphones or tablets, the various apparatus and methodologies discussed herein are not so limited. In fact, many of the apparatus and methodologies described herein are useful in any number of devices, including both mobile and fixed devices that can benefit from the short-range antenna apparatus and methodologies described herein.

Figure 2A:
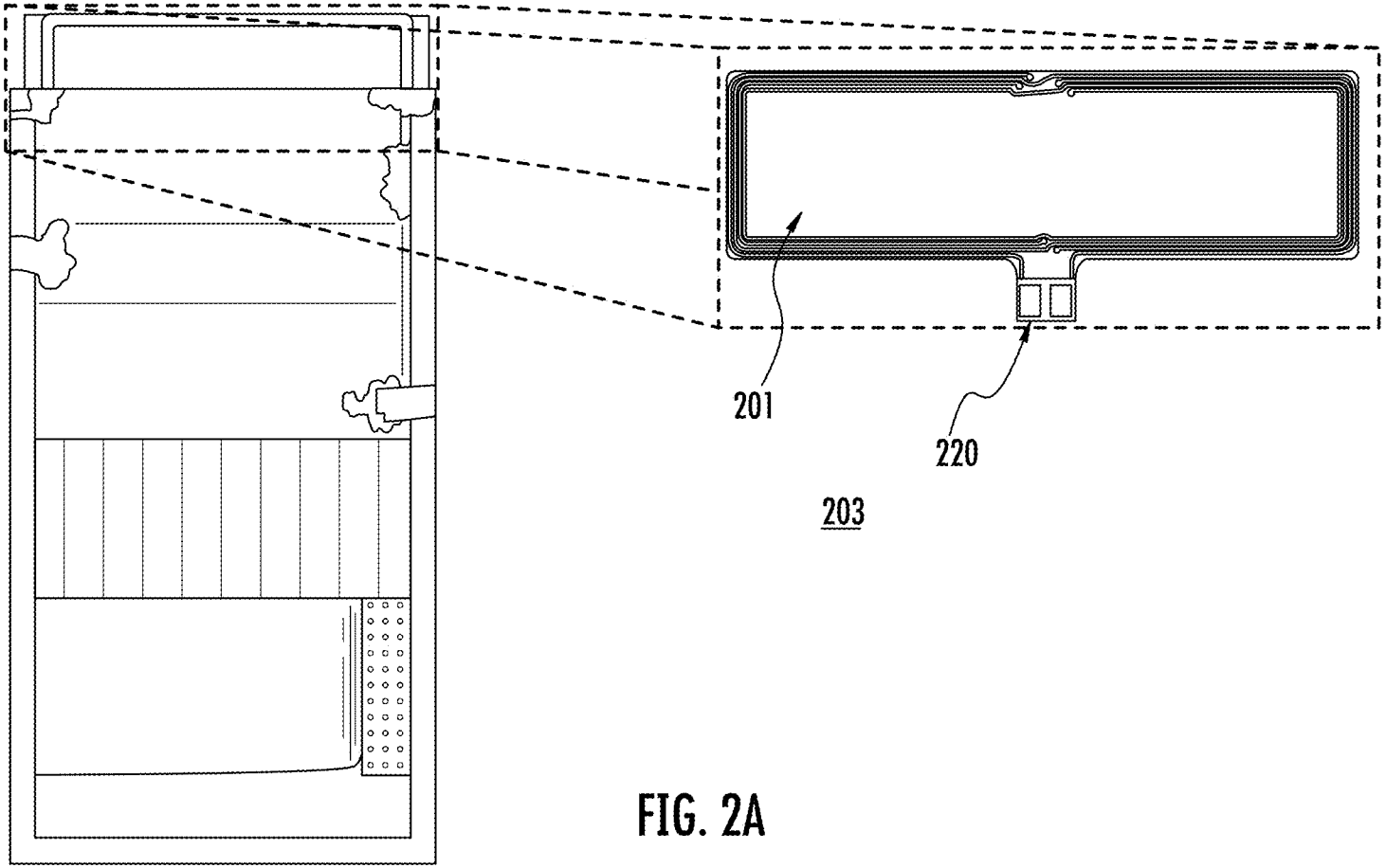
FIG. 2A is an elevation view of the cellular telephone model of FIG. 1, yet with one embodiment of the short-range antenna apparatus according to the present disclosure.
Figure 2B:
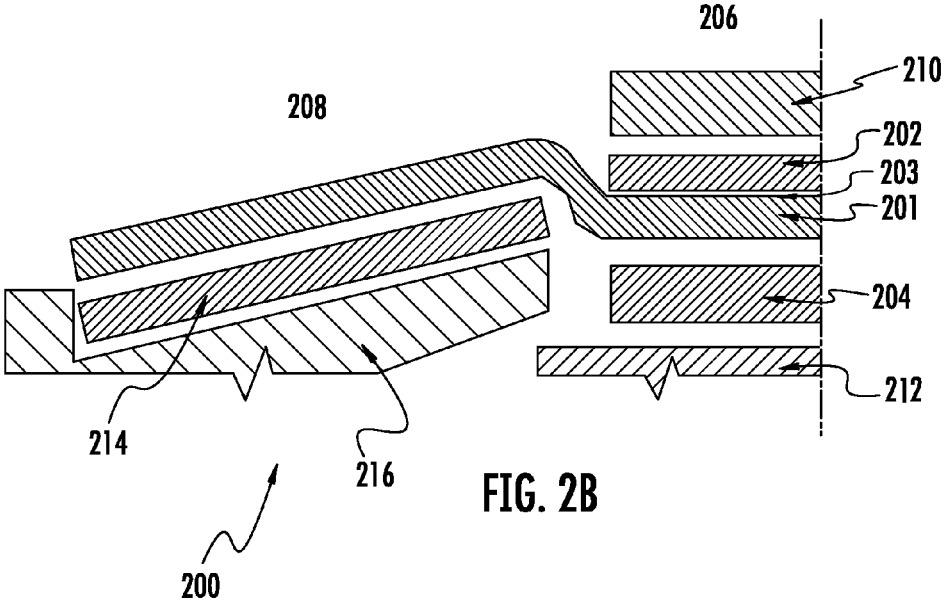
FIG. 2B is a side view of the cellular telephone and antenna apparatus of FIG. 2A, illustrating the relationship of the various components.
Figure 3:
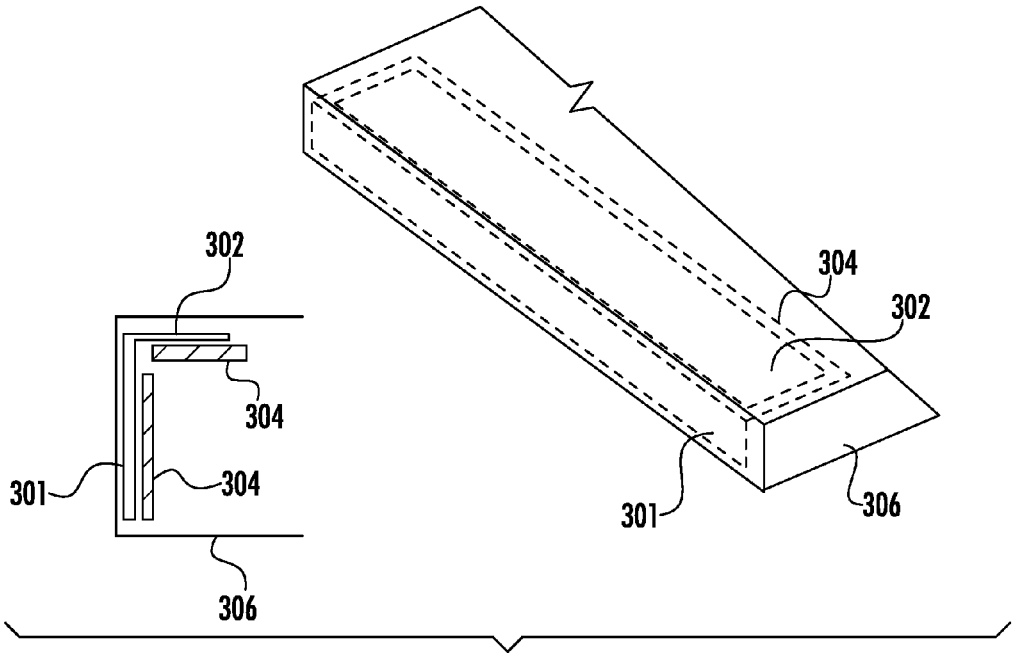
FIG. 3 is a composite cross-sectional and perspective diagram that illustrates an alternate configuration for the exemplary short range antenna apparatus of the disclosure, disposed primarily on an edge of a metal-cased smartphone.

Furthermore, while the embodiments of the antenna apparatus of FIGS. 2A-3 are discussed primarily in the context of operation within NFC wireless spectrum and applications, the present disclosure is not so limited. In fact, the antenna apparatus of FIGS. 2A-3 (and yet other embodiments which will be recognized by those of ordinary skill given this disclosure) are useful in any number of operating bands including, without limitation, the operating bands for RFID and other short-range technologies.

Exemplary Antenna Apparatus

FIG. 1 illustrates a typical prior art mobile RF device 100 (e.g., smartphone) with cover and display removed, showing the available area 102 for the short-range (e.g., NFC) antenna. As shown in this example, the area 102 for a conventional NFC antenna is quite small (here, on the order of 57 mm×7 mm), which when using the aforementioned prior art antenna configurations, causes significant issues as detailed previously herein.

Accordingly, FIGS. 2A and 2B illustrate an exemplary embodiment of the short-range antenna configuration 200 of the present disclosure, which overcomes the foregoing issues. Specifically, in the embodiment shown, an effective size of the antenna is increased, even though the "available" space is the same as in the device of FIG. 1. Specifically, and as best shown in FIG. 2B, a portion of the antenna, which is disposed on a flexible or malleable (bendable) substrate 201 is "sandwiched" between two ferrite components 202, 204. A third ferrite component 214 is used to shield the antenna element 200 from the metal cover 216. The ferrite components in effect shield the conductive traces (loop lines) 203 of the antenna 200 in areas where metals or other performance-decreasing components are in close proximity to the antenna 200. In these areas, the ferrite components 202, 204 on both sides of the NFC antenna loop allow the antenna 200 to function as an impedance matching element in regions where the antenna loop lines are covered with the ferrite. Specifically, in these regions, the loop lines 203 of the antenna generate an inductance as a conventional loop antenna; however, these loop lines 203 do not contribute to the radiation from the antenna structure as they are shielded between conductive metal. The portions of the antenna 200 that are not covered with ferrite function as a radiating area of the loop. A portion of the loop(s) can therefore also be contained underneath the display 210 or other components of the host device (including on top of the PCB), thereby economizing on space, while providing the above-described advantages of increasing the effective size of the antenna.

Stated differently, an electrically larger NFC antenna can be implemented to smaller space, and notably at least partially inside metal, PCB or other conducting material(s) that decrease the NFC antenna loop performance. Specifically, the exemplary antenna 200 illustrated in FIGS. 2A & 2B is on the order of 57 mm×16 mm in size, as compared to the prior art counterpart of 57 mm×7 mm discussed above with respect to FIG. 1, with a significant portion of the increased size being disposed under the display (i.e., between the ferrite elements 202, 204).

In the embodiment of FIG. 2B, the antenna element 200 is constructed from a sufficiently flexible or malleable material such that it can be flexed or bent so as to achieve the configuration shown in the figure (i.e., a first portion at a first orientation, and a second portion at an angle relative thereto). It will be appreciated, however, that if the requisite geometry is known in advance, the antenna element 200 can be fabricated from rigid materials (such as being disposed on a rigid substrate) which accommodates the aforementioned geometry.

A feed portion or tab 220 is also provided on the antenna 200, so that RF signals can be fed to and received from the antenna during operation by the internal RF transmission/reception circuitry of the host device (not shown). It will be appreciated that while a tab-like configuration is shown for the feed 220, any number of other configurations may be used consistent with the disclosure.

The conductive traces or "loops" of the antenna element 200 can be fabricated using any number of different approaches (or combinations thereof). For example, the antenna may be formed from a sheet of conductive material such as a copper alloy.

Alternatively, an LDS (laser direct structuring) process can be used to form the antenna 200. Recent advances in LDS antenna manufacturing processes have enabled the construction of antennas directly onto an otherwise non-conductive surface (e.g., onto thermoplastic material that is doped with a metal additive). The doped metal additive is subsequently activated by means of a laser. LDS enables the construction of antennas onto more complex three-dimensional (3D) geometries. For example, in various typical smartphones, wristwatch and other mobile device applications, the underlying device housing and/or other components on which the antenna may be disposed, is manufactured using an LDS polymer using standard injection molding processes. A laser is then used to activate areas of the (thermoplastic) material that are then subsequently plated. Typically an electrolytic copper bath followed by successive additive layers such as nickel or gold are then added to complete the construction of the antenna.

Additionally, pad printing, conductive ink printing, FPC, sheet metal, PCB processes may be used consistent with the disclosure. It will be appreciated that various features of the present disclosure are advantageously not tied to any particular manufacturing technology, and hence can be broadly used with any number of the foregoing. While some technologies inherently have limitations on making e.g., 3D-formed radiators, the inventive antenna structure can be formed by using any sort of conductive materials and processes.

However, while the use of LDS is exemplary, other implementations may be used to manufacture the coupled antenna apparatus such as via the use of a flexible printed circuit board (PCB), sheet metal, printed radiators, etc. as noted above. However, the various design considerations above may be chosen consistent with, for example, maintaining a desired small form factor and/or other design requirements and attributes. For example, in one variant, the printing-based methods and apparatus described in co-owned and co-pending U.S. patent application Ser. No. 13/782,993 and entitled "DEPOSITION ANTENNA APPARATUS AND METHODS", filed Mar. 1, 2013, which claims the benefit of priority to U.S. Provisional Patent application Ser. Nos. 61/606,320 filed Mar. 2, 2012, 61/609,868 filed Mar. 12, 2012, and 61/750,207 filed Jan. 8, 2013, each of the same title, and each of the foregoing incorporated herein by reference in its entirety, are used for deposition of the antenna radiator on the substrate.

Additionally, while the aforementioned embodiments generally comprise a single short range antenna apparatus disposed within a host device enclosure, it will also be appreciated that in some embodiments, additional antenna elements in addition to, for example, the exemplary antenna apparatus 200 of FIGS. 2A-2B can be disposed within the host device. These other antenna elements can be additional NFC-type elements (e.g., designed to operate at different frequency, in a different orientation, etc., or simply redundant to the first), or alternatively be designed to receive other types of wireless signals, such as and without limitation e.g., Bluetooth®, Bluetooth Low Energy (BLE), 802.11 (Wi-Fi), wireless Universal Serial Bus (USB), AM/FM radio, International, Scientific, Medical (ISM) band (e.g., ISM-868, ISM-915, etc.), ZigBee®, etc., so as to expand the functionality of the portable device, yet maintain a spatially compact form factor.

Alternate Geometries

It will be appreciated that the reduced "footprint" and dimensions of the exemplary short-range antenna as described herein advantageously allows for positioning (or deposition) of the antenna on any number of locations where previously not possible (and/or in other geometries), in addition to or in place of those described with respect to FIGS. 2A-2B above. For example, as shown in FIG. 3, the antenna can be disposed in a variety of different locations, such as on one or more edges of the metal cover of the host device. In this illustration, the radiating portion 301 is disposed primarily along the edge surface (i.e., parallel to the plane of the edge) of a metal or partly metal casing 306, whereas the impedance matching portion 302 is disposed primarily on a top or bottom face of the device, along with one or more ferrite elements 304 similar to the embodiment of FIGS. 2A-2B discussed above. It will be appreciated that more or less ferrite elements can be used as needed, in order to obtain the desired impedance matching and antenna performance.

In yet another embodiment (not shown), the antenna can be disposed on one or more edges of a PCB. For instance, the radiating portion of the antenna element can occupy most or all of the free space around the perimeter of the PCB (including the planar top/bottom surfaces, and even feasibly the vertical edge area provided by the side of the PCB).

In yet another variant, the antenna is disposed on an edge of another component within the host apparatus, such as e.g., a Lithium Ion or Nickel Cadmium battery. The antenna can be made fixed or removable from the battery (such as via use of an adhesive or other fastening mechanism such as Velcro™), or alternatively can be permanent on the battery, and even included with the battery when manufactured and sold (e.g., as part of a replacement battery, wherein the user or technician swaps out the battery and antenna simultaneously, and makes up the feed to the new antenna simultaneously when electrically connecting the new battery).

Exemplary Performance Data

Referring now to FIGS. 4A-6C, performance results obtained during testing by the Assignee hereof of an exemplary short range antenna apparatus constructed according to the present disclosure, such as that illustrated in FIGS. 2A-2B, are presented.

Figure 4A:
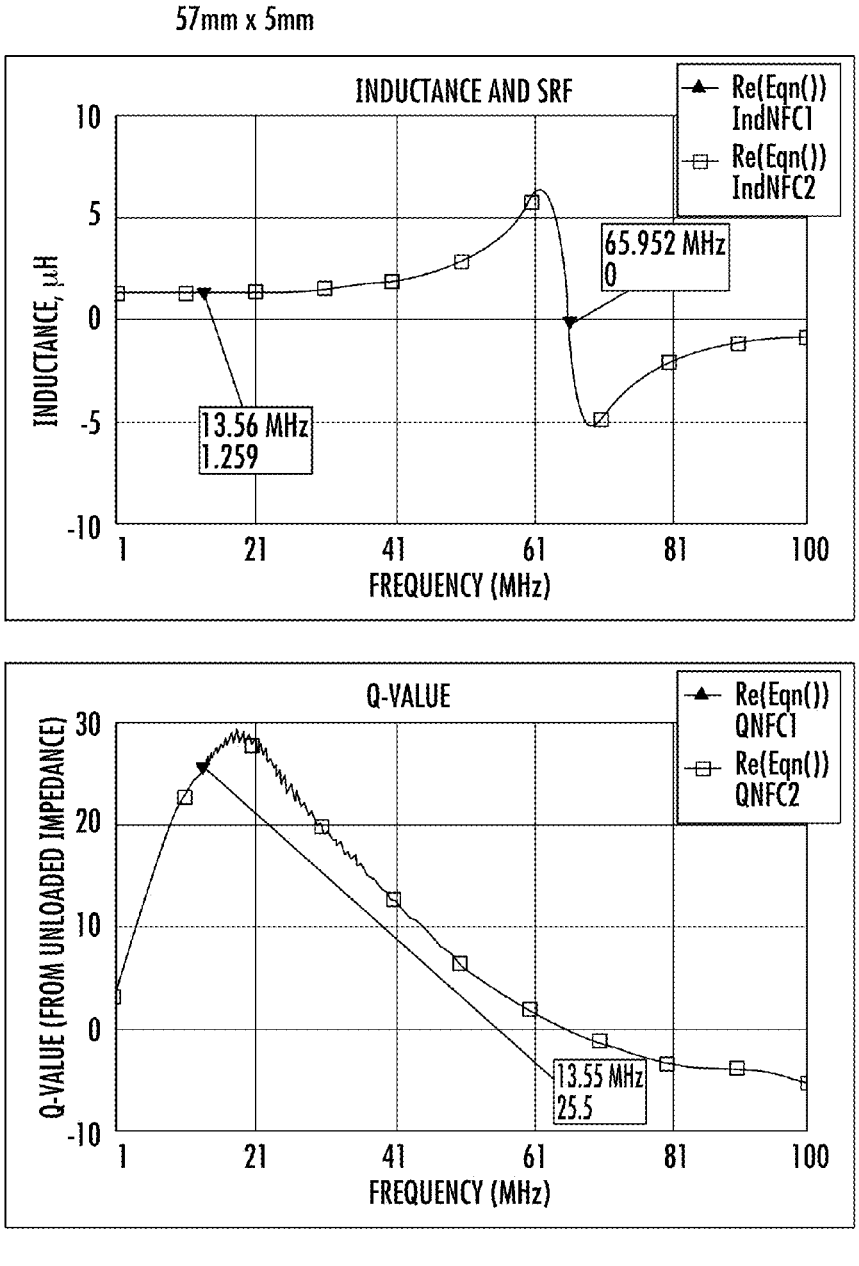
FIG. 4A (PRIOR ART)
FIGS. 4A-4C are graphs of inductance, Q-value, and self-resonance frequency (SRF) for prior art 57×5 mm and 57×7 mm antenna form factors, and one embodiment (54×16 mm) of the inventive antenna of the present disclosure, respectively.
Figure 4B:
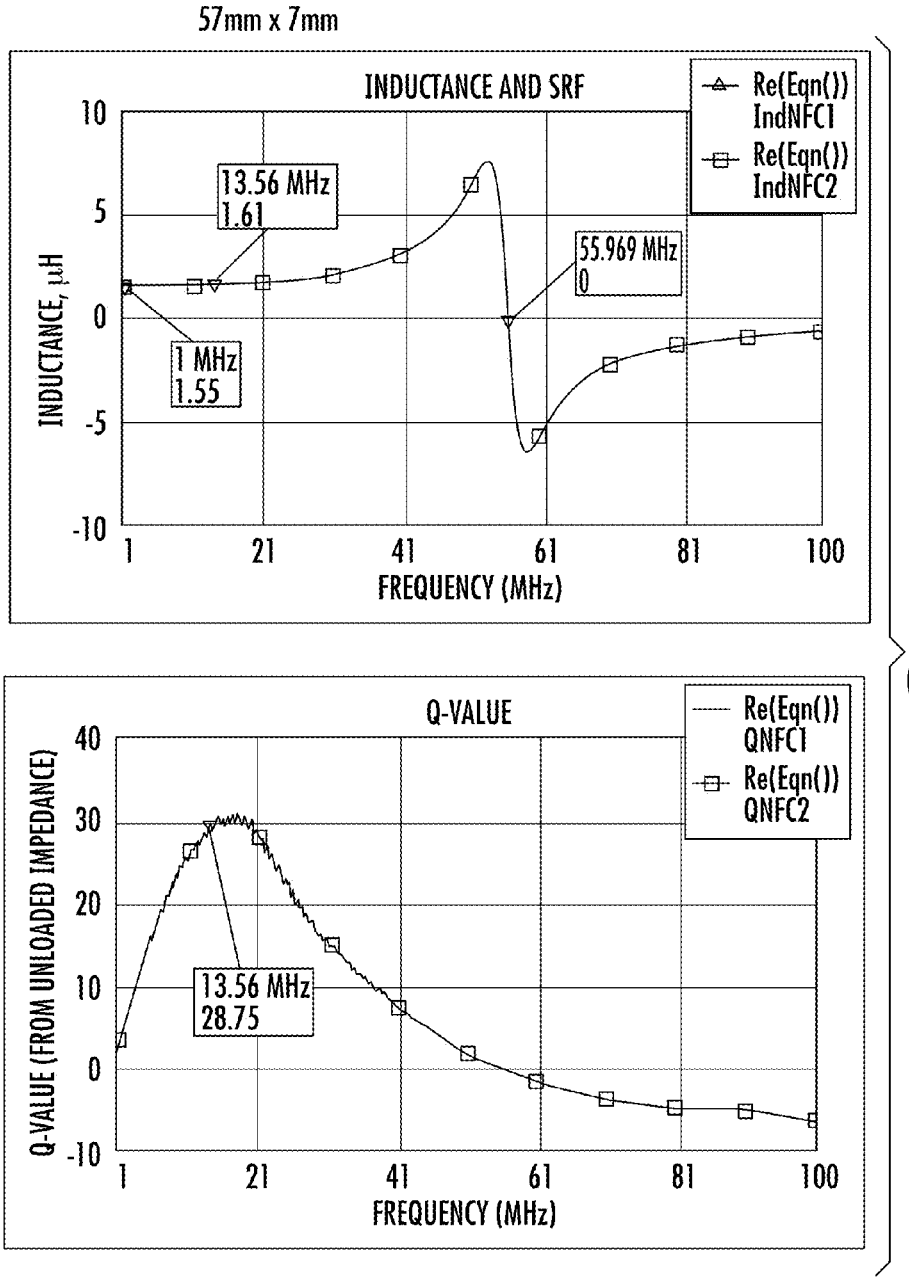
FIG. 4B (PRIOR ART)
Figure 4C:
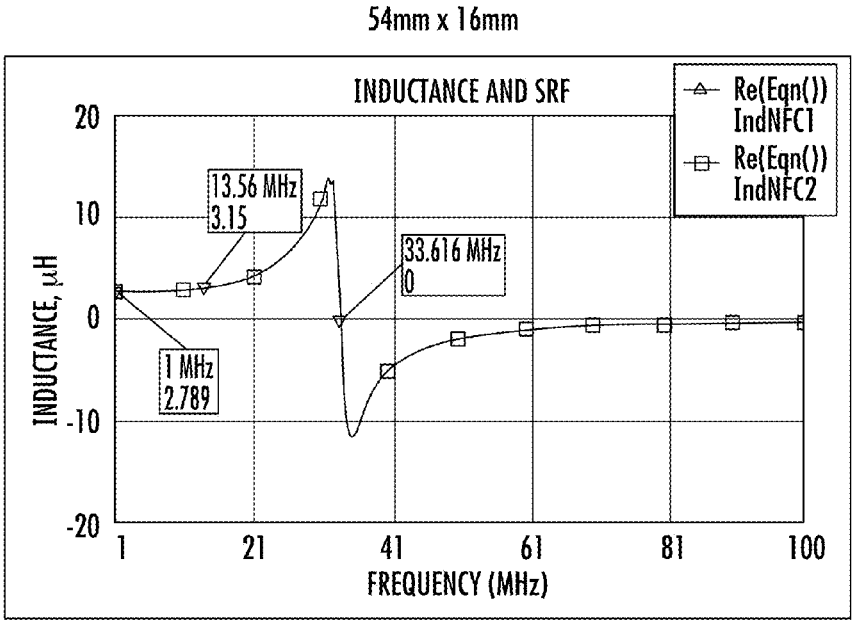
Figure 4C:
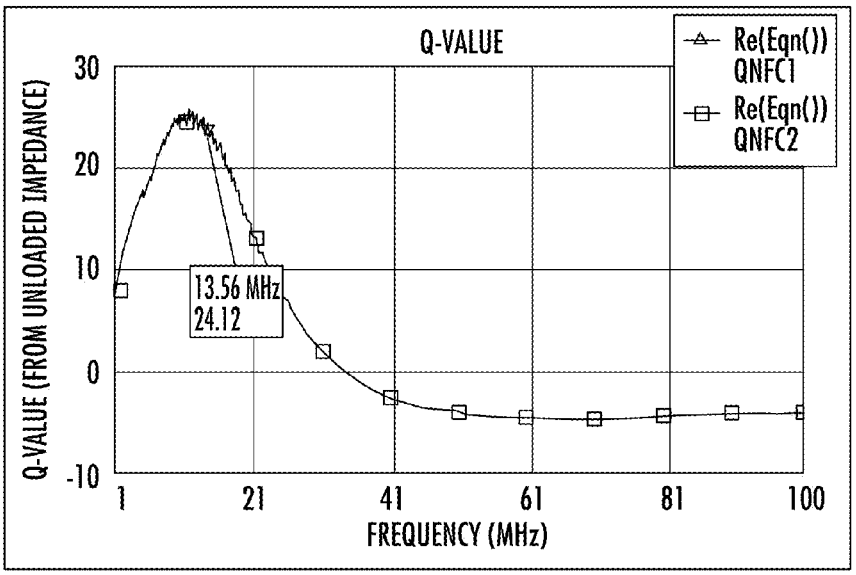

FIGS. 4A-4C are graphs of inductance, Q-value, and self-resonance frequency (SRF) for prior art 57×5 mm and 57×7 mm antenna form factors, and one embodiment (54×16 mm) of the antenna of the present disclosure, respectively. As shown in FIG. 4C, the inductance of the antenna can be significantly increased over the smaller prior art implementations by use of the methods described herein, while maintaining a suitable Q value. For instance, at 13.56 MHz (a typical NFC antenna frequency), the inductance values for the two prior art antennas are roughly 1.2 and 1.6 microH, respectively, whereas the exemplary embodiment of the inventive antenna has a value of about 3.2 microH. Hence, the inventive antenna "looks" larger electrically, while still only utilizing the same available space within the host device.

Figure 5A:
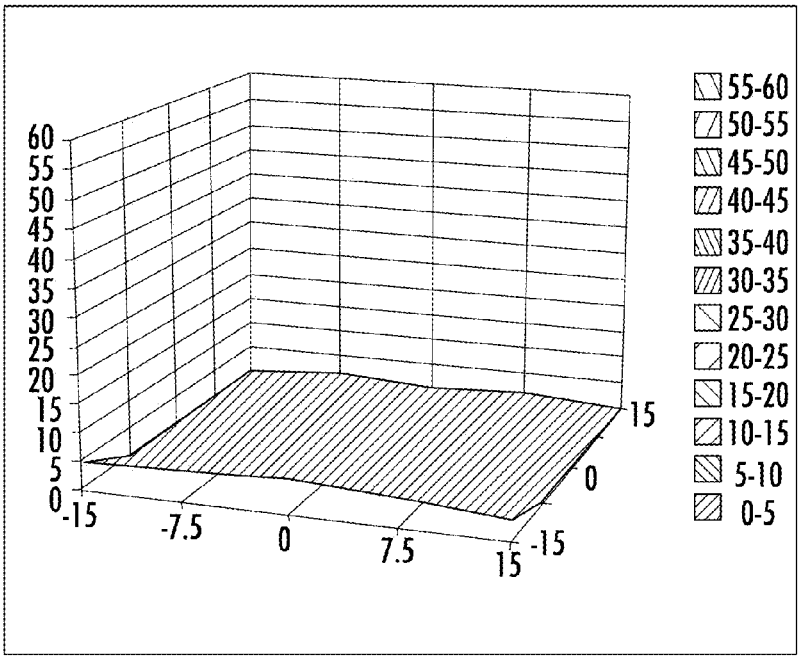
FIG. 5A (PRIOR ART)
FIGS. 5A-5C are tables and plots showing results for a reader/writer grid scan for prior art 57×5 mm and 57×7 mm antenna form factors, and one embodiment (54×16 mm) of the inventive antenna of the present disclosure, respectively.
Figure 5B:
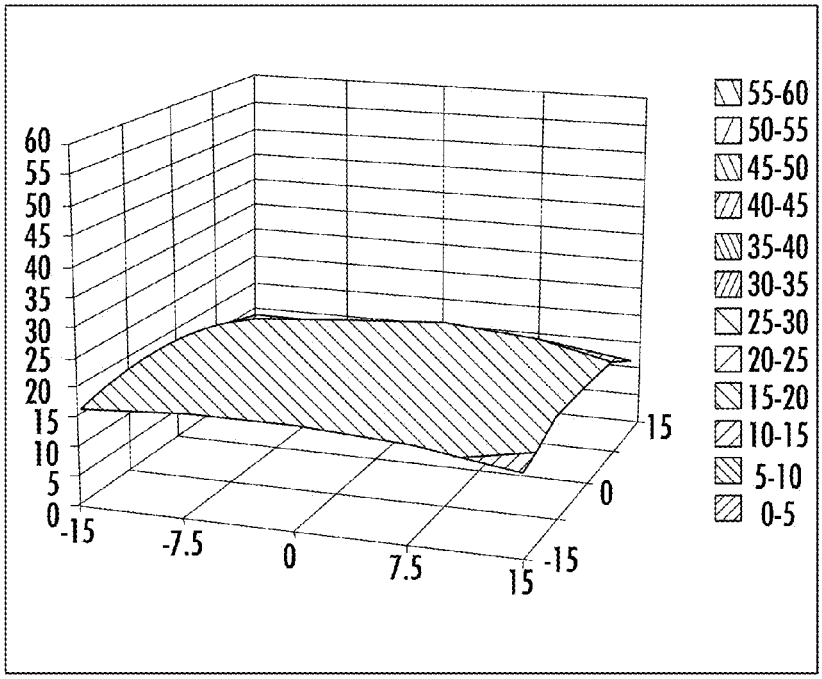
FIG. 5B (PRIOR ART)
Figure 5C:
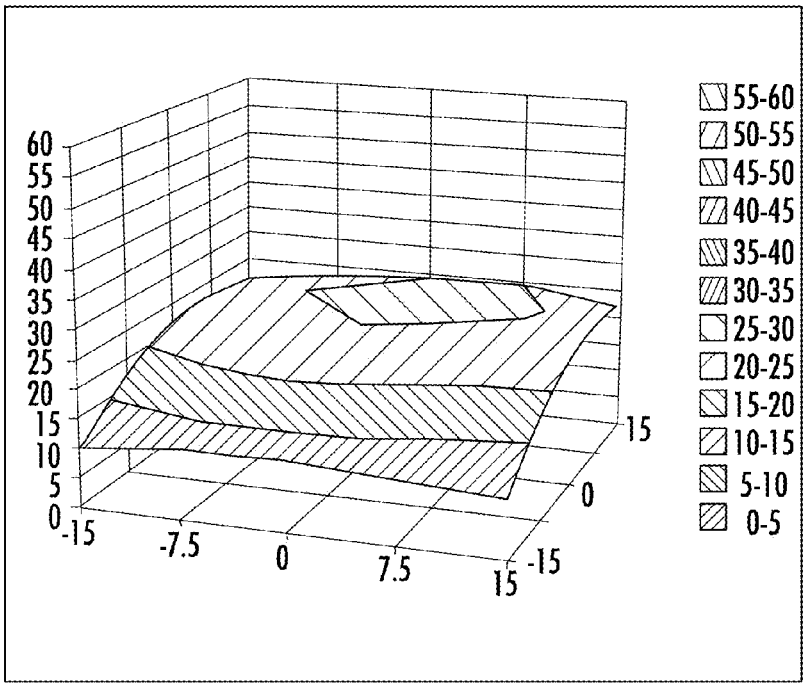
FIG. 5C (PRIOR ART)

FIGS. 5A-5C are tables and plots showing results for a reader/writer grid scan for prior art 57×5 mm and 57×7 mm antenna form factors, and one embodiment (54×16 mm) of the antenna of the present disclosure, respectively. The data represents limit reading distances against an exemplary Mifare 1K NFC card. As illustrated, the exemplary inventive antenna of FIG. 5C provides desirable electrical (and field/distance) performance, along with the attributes referenced above regarding flexibility of placement and configuration.

FIGS. 6A-6C are tables showing EMVCo load modulation for prior art 57×5 mm and 57×7 mm antenna form factors, and one embodiment (54×16 mm) of the antenna of the present disclosure, respectively. The figures illustrate testing at various different positions over an exemplary EMVCo test proximity coupling device (PCD). The values/results are in mV for a given load modulation amplitude. The illustrated percentages represent the gap between the results and EMVCo target specification at each test point. As shown, the exemplary embodiment of the antenna provides a high level of performance relative to the various prior art solutions.

Table 1 below summarizes the exemplary test data discussed above.

TABLE 1

| Performance Summary | | | |
|---|---|---|---|
| | Antenna Form Factor | | |
| Parameter | 57 mm × 5 mm (Prior art) | 57 mm × 7 mm (Prior art) | 57 mm × 16 mm |
| Q-value | 25 | 30 | 24 |
| Inductance at 13.56 MHz | 1.26 nH | 1.61 nH | 3.15 nH |
| SRF (Self resonance frequency) | 66 MHz | 56 MHz | 34 Mhz |
| Resistance at 13.56 MHz | 4.2 Ohm | 4.6 Ohm | 11.1 Ohm |

TABLE 1-continued

| Performance Summary | | | |
|---|---|---|---|
| | Antenna Form Factor | | |
| Parameter | 57 mm × 5 mm (Prior art) | 57 mm × 7 mm (Prior art) | 57 mm × 16 mm |
| Reading distance (Z) relative to EMVCo test PCD. | 0 cm | 0 cm | 2-3 cm |
| Grid scan max. reading distance (mm) | 6 mm | 20 mm | 26 mm |
| Grid scan avg. reading distance (mm) | 1.1 mm | 16.7 mm | 20.5 mm |

It will be recognized that while certain aspects of the present disclosure are described in terms of a specific sequence of steps of a method, these descriptions are only illustrative of the broader methods of the disclosure, and may be modified as required by the particular application. Certain steps may be rendered unnecessary or optional under certain circumstances. Additionally, certain steps or functionality may be added to the disclosed embodiments, or the order of performance of two or more steps permuted. All such variations are considered to be encompassed within the disclosure disclosed and claimed herein.

While the above detailed description has shown, described, and pointed out novel features of the antenna apparatus as applied to various embodiments, it will be understood that various omissions, substitutions, and changes in the form and details of the device or process illustrated may be made by those skilled in the art without departing from the fundamental principles of the antenna apparatus. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A short-range antenna apparatus, comprising:

at least one antenna loop, the at least one loop comprising a first portion and a second portion, the first portion disposed at an angle relative to the second portion; and two or more discrete shielding components that are configured to cover the second portion of the at least one antenna loop on at least two sides thereof;

wherein the first portion is configured to operate as a radiating portion, and the second portion is configured to operate as an impedance matching portion.

2. The apparatus of claim 1, wherein the at least one antenna loop is configured to operate as a near-field antenna for very short-range communications.

3. The apparatus of claim 1, wherein the at least one antenna loop is configured to operate at a frequency between 13 MHz and 14 MHz.

4. The apparatus of claim 3, wherein the antenna apparatus is compliant with an EMVCo standard when operated at the frequency.

5. The apparatus of claim 1, wherein the two or more discrete shielding components are configured to shield at least the second portion from one or more metallic components proximate the antenna loop.

6. A wireless enabled mobile device, comprising:

a short-range radio frequency antenna comprising at least one loop, the at least one loop comprising a first radiating portion and a second portion, the second portion disposed proximate one or more metallic components in the device; and at least one shielding element disposed proximate the one or more metallic components and configured to shield at least a portion of the second portion from the one or more metallic components;

wherein the short-range radio frequency antenna further comprises a substrate, the first radiating portion and the second portion of the at least one loop being formed on or in the substrate; and wherein the second portion of the at least one loop comprises an impedance matching portion and the second portion of the at least one loop is disposed between the at least one shielding element.

7. The device of claim 6, wherein the second portion provides at least an impedance matching function for the short-range antenna.

8. The device of claim 6, wherein the short-range radio frequency antenna is disposed on the substrate, the at least one shielding element comprises two shielding elements, and at least a portion of the substrate and the second portion are disposed substantially between the two shielding elements.

9. The device of claim 6, wherein the at least one shielding element allows the short-range antenna to be larger than it would be otherwise with no shielding element.

10. The device of claim 6, wherein the at least one shielding element allows the short-range antenna to have an increased effective or electrical size.

11. The device of claim 6, further comprising:

a display element; and a printed circuit board;

wherein the at least one shielding element comprises two shielding elements; and wherein at least a portion of the substrate is disposed between the two shielding elements, and at least a portion of each of the two shielding elements is disposed between the display element and the circuit board.

12. A method of configuring a near-field antenna for use within a host device, the method comprising:

providing at least one conductive loop;

disposing a first portion of the at least one loop such that it can radiate electromagnetic energy, and a second portion of the at least one loop is proximate one or more components of a host device, and such that the second portion acts as an impedance matching element;

wherein the second portion of the at least one loop is sandwiched between at least two layers of ferrite.

13. The method of claim 12, wherein the near-field antenna, when configured according to the method, is capable of utilizing a metal-free region of a host device that is smaller than a size of the at least one conductive loop.

14. The method of claim 12, further comprising shielding the second portion from the one or more components of the host device so as to facilitate said impedance matching.

15. A wireless device, comprising:

an at least partly metallic case or housing;

a near-field wireless transceiver;

at least one shielding element; and a near field antenna disposed proximate the case or housing, the near field antenna comprising a first radiating portion disposed proximate a metal-free region of the case or housing, and a second portion disposed proximate to both the at least one shielding element and a metallic portion of the case or housing;

wherein the at least one shielding element is configured to shield the second portion of the near field antenna from the metallic portion of the case or housing, such that only the first radiating portion of the near field antenna radiates electromagnetic energy from the wireless device.

16. A short-range antenna assembly comprising:

an antenna comprising a loop, the loop comprising conductive traces disposed on a malleable substrate; and a plurality of shielding components configured to shield the conductive traces of the antenna assembly;

wherein:

a first portion of the conductive traces is disposed on a first portion of the substrate, and a second portion of the conductive traces is disposed on a second portion of the substrate, the first and second portions of the substrate being disposed at a non-parallel angle with respect to each other;

the first portion of the substrate is disposed proximate to a first one of the plurality of shielding components such that the first portion of the conductive traces comprises a radiating portion of the loop; and the second portion of the substrate is disposed between second and third ones of the plurality of shielding components such that the second portion of the conductive traces is sandwiched between the second and third shielding components, thereby (i) enabling the second portion of the conductive traces to provide impedance matching and (ii) enabling an increased size of the antenna relative to an antenna without the second portion of the conductive traces sandwiched between the second and third shielding components.

17. The assembly of claim 16, wherein the plurality of shielding elements comprise ferrite shielding elements.

18. The assembly of claim 16, wherein the first one of the plurality of shielding components is configured to shield the first portion of the conductive traces from a metal cover disposed proximate the antenna assembly.

* * * * *